United States Patent [19]

Emerson

[11] Patent Number: 4,542,587

[45] Date of Patent: Sep. 24, 1985

[54] DRAWING COMPASS APPARATUS

[76] Inventor: Clarence A. Emerson, 116 Sunset Blvd., Bozeman, Mont. 59715

[21] Appl. No.: 573,464

[22] Filed: Jan. 24, 1984

[51] Int. Cl.[4] ..... B43L 9/20

[52] U.S. Cl. ..... 33/27 B; 33/149 H; 33/152 B

[58] Field of Search ..... 33/27 B, 27 R, 27 E, 33/149 H, 152 R, 152 B

[56] References Cited

U.S. PATENT DOCUMENTS

| | | | |
|---|---|---|---|
| 515,075 | 2/1894 | Deats | 33/152 B |
| 3,537,181 | 11/1970 | Graef | 33/149 H X |
| 3,683,505 | 8/1972 | Graef | 33/149 H X |

*Primary Examiner*—William D. Martin, Jr.
*Attorney, Agent, or Firm*—Arthur L. Urban

[57] ABSTRACT

Drawing compass apparatus includes an axis defining portion, a grip portion, and a fastening portion. The axis defining portion includes an elongated leg member, the leg member having a blunt end section, and a short point section extending from a part of the blunt end section. A circular section is disposed at an end of the leg member opposite to the blunt end section thereof, the circular section being disposed offset of a longitudinal axis of the leg member. A longitudinal groove extends along the full length of the axis defining portion with the circular section having a central opening offset from the longitudinal groove. The grip portion includes a circular member disposed adjacent to the circular section of the axis defining portion, the circular member including a central opening aligned with the central opening of the circular section. The circular member includes a straight groove across a surface thereof, the groove being offset from the central opening thereof the same distance as the longitudinal groove of the axis defining portion is from the central opening of the circular section thereof. The straight groove of the circular member extends away from the circular section of the axis defining portion, with the longitudinal groove of the axis defining portion extending away from the circular member; the fastening portion extends through the central openings of the circular section and the circular member and secures same together.

10 Claims, 5 Drawing Figures

DRAWING COMPASS APPARATUS

This invention relates to a novel compass apparatus and more particularly relates to a new apparatus for drawing circles.

Through the ages, a wide variety of different articles have been employed to draw circles. Originally, people used circular structures which they found naturally or shaped to the desired configuration. Such makeshift structures still are used for incidental drawing by many individuals.

While such devices provide satisfactory results in some situations, in other cases they may have serious deficiencies. For example, each device is only suitable for drawing a specific size circle. Thus, it is necessary to collect a number of articles to provide for circles of differing diameters.

Although a collection of devices enables a person to draw a number of different size circles, it only provides for the specific sizes and not for other sizes in between. Thus, it may be necessary for the user to compromise in the size he will draw or else seek still another device of the appropriate diameter. While such compromises may be acceptable in some situations, in others they may be totally unsatisfactory.

To avoid the compromises discussed above, compass devices have been developed to provide infinite size selection. Such compasses ordinarily include two arms pivotally connected adjacent one end thereof. The free ends of the arms are moved away from each other to a distance which is the radius of the desired circle.

The compass is used by placing a free end of one of the arms at the center of the circle to be drawn and then rotating the second arm around the first arm as an axis. In this way, a uniform circle can be drawn. The first arm may be a stylus and the second arm a marker such as a pencil, pen, chalk or the like. To draw circles of different diameters, it only is necessary to space the free ends of the first and second arms closer or wider apart.

Compasses have been used by students for many years with a fair degree of satisfaction. However, they are not without their own problems. For example, a high degree of care must be exercised in order to avoid inadvertently changing the spacing between the first and second arms while scribing the circle.

When a compass is relatively new, there is a reasonable degree of frictional resistance at the pivot point between the arms. However, after a compass has been in service for some time, the frictional resistance decreases considerably. As a result, accidentally misapplied pressure can change the spacing between the arms and this readily may occur as a circle is being described.

Another shortcoming of conventional compasses is the sharp long steel point that is utilized as the stylus. This point can jab a person's fingers or other object during use. Also, the steel point presents the same problem when the compass is being carried or stored. In order to avoid such injury or damage, care must be exercised in handling either by properly grasping the compass or by wrapping or enclosing it. In addition, the sharp point may become a weapon in the hands of a belligerent student.

In an attempt to overcome the above deficiencies and shortcomings of common compasses, U. S. Pat. No. 3,683,505 discloses a circle marker which includes a pair of clamp members. The clamp members are used in combination or with a center support body. The clamp members include anchor sections that hold pencils or other markers. Connector means maintain the clamp members in contact. The patent alleges that the structure holds the markers more securely. Also, the points can be slid behind the clamp members to shield them for carrying.

Although in theory circle markers of the above type include features that may overcome the shortcomings of conventional compasses, in actual use such circle markers still have certain deficiencies. The two movable marker means are difficult to hold in position while the clamp members are being adjusted. Also, it is a nuisance to have to slide two markers to positions in which the points thereof are behind the clamp members.

All of these operations require considerable dexterity and time. As a result, many students simply cannot or will not perform the necessary steps and thus risk injury or damage to other articles. This is true especially with youngsters who need the protection the most.

In view of the above discussion, it is clear that previous devices and methods do not provide a device for forming circles that functions satisfactorily in many situations. Therefore, there is a need for a new compass apparatus that overcomes the deficiencies of earlier devices.

The present invention provides a novel compass apparatus for drawing circles with advantages and features not found in previous devices. The drawing compass apparatus of the invention can be used safely and conveniently. Little adjustment is required to use the apparatus and to place it in a storage position. The risk of injury to the user or others as well as damage to adjacent articles is greatly reduced. The apparatus maintains a preselected position and avoids accidental changes in position as the apparatus is being used.

The compass apparatus of the present invention is simple in design and can be produced relatively inexpensively. Commercially available materials and components can be used. Conventional compass fabricating and metal working techniques and procedures can be employed in the manufacture of the apparatus.

The compass apparatus of the invention can be used safely by persons of all ages, even by those with limited dexterity. Adjustment of the apparatus can be accomplished easily and quickly after only a minimum of instruction.

The compass apparatus is durable in construction and has a long useful life. A high level of performance is achievable without wear or deterioration of components even after long service.

These and other benefits and advantages of the novel drawing compass apparatus of the invention will be apparent from the following description and the accompanying drawings in which.

Figure 1:
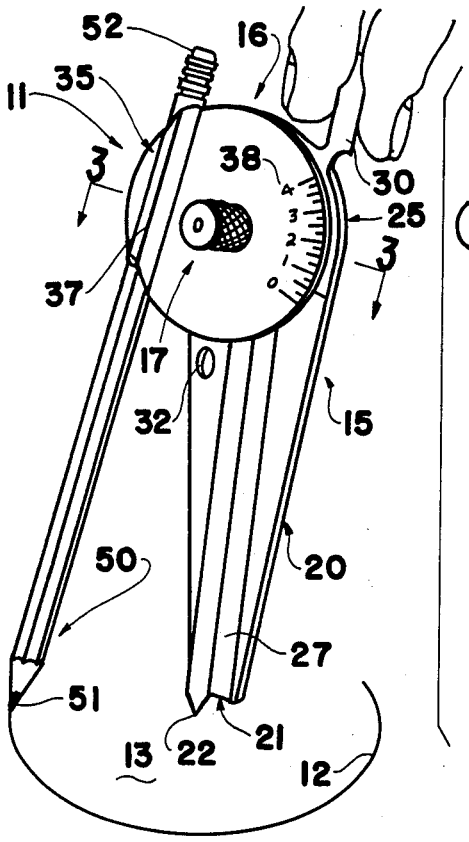
FIG. 1 is a side elevation of one form of the drawing compass apparatus of the invention in use.
Figure 2:
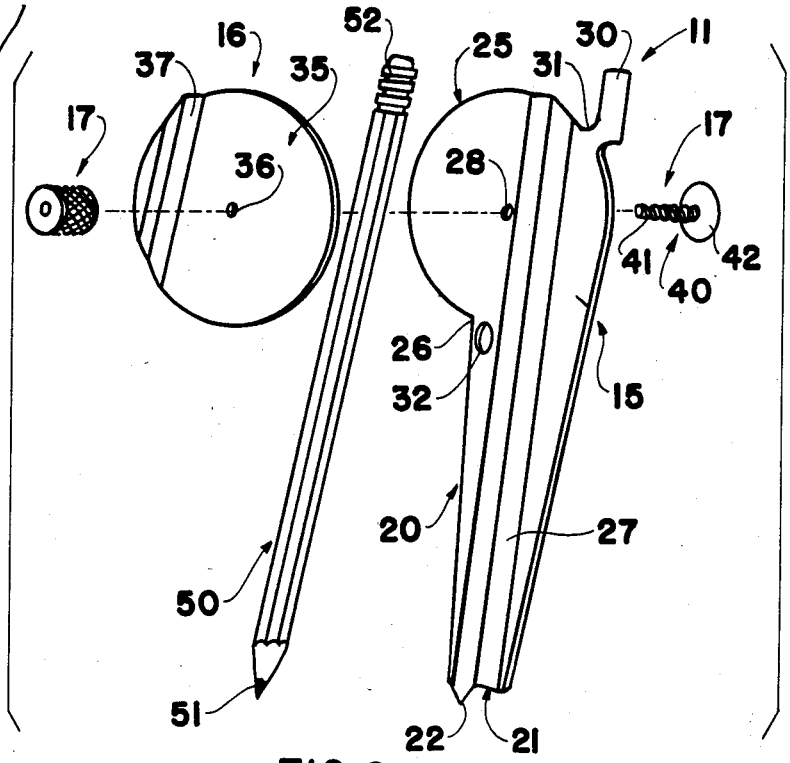
FIG. 2 is a view in perspective of the compass apparatus shown in FIG. 1 with components separated.
Figure 3:
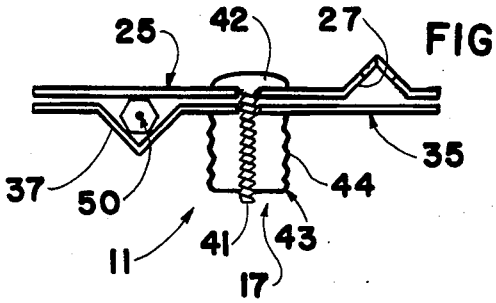
FIG. 3 is a sectional view of the compass apparatus shown in FIG. 1 taken along line 3—3 thereof.

In the drawings, one form of the novel compass apparatus 11 of the present invention is shown in use forming a circle 12 on a base surface 13. The drawing compass apparatus 11 includes an axis defining portion 15, a grip portion 16 and a fastening portion 17.

The axis defining portion 15 of the compass apparatus 11 of the invention includes an elongated leg member 20. The leg member has a blunt end section 21. Advantageously, the leg member tapers toward the blunt end section. A short point section 22 extends from a part of the blunt end section, preferably adjacent one corner 23 thereof.

The axis defining portion 15 also includes a circular section 25. The circular section 25 is disposed at an end 26 of the leg member 20 that is opposite to the blunt end section 21. The circular section 25 is disposed offset of a longitudinal axis of the leg member.

A longitudinal groove 27 extends along the full length of the axis defining portion 15. The longitudinal groove advantageously is disposed along a longitudinal axis of the leg member 20. The circular section 25 has a central opening 28 that is offset from the longitudinal groove 27.

The axis defining portion 15 preferably includes a knob section 30. The knob section is located at an end 31 thereof remote from the leg member 20. Advantageously, the knob section is disposed adjacent end 31 of the longitudinal groove 27.

In addition, the axis defining portion may include an opening 32 therethrough. This opening facilitates storing the apparatus on a notebook ring, wall peg or the like. The opening 32 advantageously is located adjacent the junction of the leg member 20 with the circular section 25.

The grip portion 16 of the compass apparatus 11 of the invention includes a circular member 35. The circular member 35 is disposed adjacent to the circular section 25 of the axis defining portion 15 and preferably in face to face contact therewith. The circular member 35 includes a central opening 36 that is aligned with the central opening 28 of the circular section. The circular section 35 further preferably includes a scale section 38 that is disposed along a part of the periphery thereof.

The circular member 35 further includes a straight groove 37 across the surface thereof. The straight groove 37 is offset from the central opening 36 the same distance as the longitudinal groove 27 of the axis defining portion is from the central opening 28 of the circular section 25.

The straight groove 37 extends away from the circular section 25 and the longitudinal groove 27 extends away from the circular member 35. Advantageously, the straight groove 37 and the longitudinal groove 27 are of substantially the same size and configuration. Preferably, the configuration of each groove is generally V-shaped with a depth less than about one-half the diameter of a marker member described hereafter.

The circular member 35 advantageously is substantially the same diameter as the circular section 25. The leg member 20 preferably has a length significantly greater than the diameter of the circular section and the circular member. It is desirable that one edge of the leg member 20 be disposed tangentially of the circular section 25.

The fastening portion 17 of the compass apparatus 11 includes a bolt member 40 with a threaded section 41 at one end and an enlarged head section 42 at the other end. The bolt member 40 extends through the central opening 28 of the circular section 25 and through the central opening 36 of the circular member 35.

A nut member 43 is engageable with threaded section 41 of the bolt member 40. The nut member 43 advantageously includes a knurled outer surface 44 to facilitate holding thereof.

The compass apparatus 11 of the invention may be fabricated from any of a variety of different materials. Suitable materials include metals, wood, plastics, combinations thereof and the like.

Figure 4:
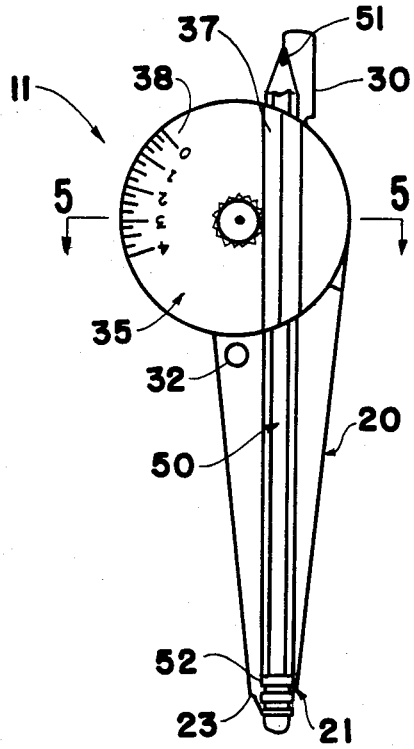
FIG. 4 is a side view of the compass apparatus shown in FIG. 1 in a storage position.
Figure 5:
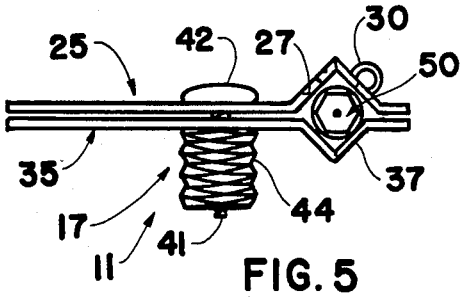
FIG. 5 is a sectional view of the compass apparatus shown in FIG. 4 taken along line 5—5 thereof.

In the use of the compass apparatus 11 of the invention as shown in the drawings, the apparatus initially is in a storage position (FIG. 4). The nut member 43 first is loosened so that circular member 35 can be rotated with respect to circular section 25 to the working position shown in FIG. 1. Since marker or pencil 50 is retained in groove 37 of the circular member, it will move with circular member 35 from a position adjacent to longitudinal groove 27 to a position remote therefrom. At the same time, point 51 of the pencil or other marker will move from adjacent the knob section 30 to a position in which the point is remote from the knob section and closely adjacent to the short point section 22 at the end of the leg member 20.

The distance between the pencil point 51 and the short point section 22 is selected to be the radius of the circle to be drawn. The projection of the pencil can be adjusted by sliding it along groove 37. The nut member 43 then is tightened and the apparatus 11 is ready for use.

The compass apparatus 11 is used in the same way as a conventional compass with the pencil point being rotated about the short point section 22 to draw the circle. When the circle has been completed and it is desired to store the apparatus 11, nut member 43 is loosened again so the circular member 35 and the pencil 50 can be returned to the position shown in FIG. 4.

The pencil then will be located between the grooves 27 and 37. It can be slid therebetween until the eraser end 52 thereof covers the short point section 22 and the pencil point 51 is hidden between the circular section 25 and the circular member 35. The apparatus now can be carried safely without fear of the short point section 22 or the pencil point 51 accidentally jabbing either the carrier person or a nearby surface and causing injury or damage.

The above description and the accompanying drawings show that the present invention provides a novel compass apparatus with features and advantages not found in previous devices. The compass apparatus of the invention can be used safely and conveniently. Risk of injury or damage from sharp points is substantially eliminated. The short point may pierce the skin but cannot make a deep wound, even if the apparatus is accidentally or intentionally misused.

The compass apparatus of the invention can be produced from commercially available materials and components using conventional compass fabricating techniques. The apparatus is durable in construction and has a long useful life. Accidental spacing changes are prevented even after extensive service and wear.

The compass apparatus is suitable for use by persons of all ages including youngsters and those with limited dexterity. The apparatus can be manipulated and used easily after only a minimum of instruction.

It will be apparent that various modifications can be made in the compass apparatus described above and shown in the drawings. The size, configuration and arrangement of components can be changed to meet specific requirements. The knob section and the fastening portion also can be different as desired. These and other changes can be made in the above compass apparatus provided the functioning and operation thereof are not adversely affected. Therefore, the scope of the present invention is to be limited only by the following claims.

What is claimed is:

1. Drawing compass apparatus including an axis defining portion, a grip portion, and a fastening portion; said axis defining portion including an elongated leg member, said leg member having a blunt end section a short point section extending from a part of said blunt end section, a circular section disposed at an end of said leg member opposite to said blunt end section thereof, said circular section being disposed offset of a longitudinal axis of said leg member, one edge of said leg member being disposed tangentially of said circular section, a longitudinal groove extending along the full length of said axis defining portion, said circular section having a central opening offset from said longitudinal groove; said grip portion including a circular member disposed adjacent to said circular section of said axis defining portion, said circular member being substantially the same diameter as said circular section, said circular member including a central opening aligned with said central opening of said circular section, said leg member having a length significantly greater than the diameters of said circular section and said circular member, said circular member including a straight groove across a surface thereof, said groove being offset from said central opening thereof the same distance as the longitudinal groove of said axis defining portion is from said central opening of said circular section thereof, said straight groove of said circular member extending away from said circular section of said axis defining portion, said longitudinal groove of said axis defining portion extending away from said circular member, said longitudinal groove and said straight groove having depths less than about one-half the diameter of said marker member; said fastening portion extending through said central openings of said circular section and said circular member and securing same together, said fastening portion including a bolt member with a threaded section and an enlarged head section and a nut member engageable with said threaded section of said bolt member; whereby an elongated marker member may be inserted between said circular section and said circular member and aligned with said straight groove of said circular member and said circular member and said marker member rotated to be disposed at an angle to said leg member so that said apparatus can circumscribe a circle about said short point section thereof.

2. Drawing compass apparatus according to claim 1 wherein said longitudinal groove of said axis defining portion is disposed along a longitudinal axis of said leg member.

3. Drawing compass apparatus according to claim 1 wherein said leg member is tapered toward the blunt end section thereof.

4. Drawing compass apparatus according to claim 1 wherein said short point section of said blunt end section is disposed adjacent one corner thereof.

5. Drawing compass apparatus according to claim 1 wherein said axis defining portion includes a knob section at an end thereof remote from said leg member.

6. Drawing compass apparatus according to claim 5 wherein said knob section is disposed adjacent an end of said longitudinal groove.

7. Drawing compass apparatus according to claim 1 wherein said axis defining portion includes an opening therethrough located adjacent the junction of said leg member and said circular section.

8. Drawing compass apparatus according to claim 1 wherein said straight groove of said circular member is substantially the same size and configuration as said longitudinal groove of said axis defining portion.

9. Drawing compass apparatus according to claim 1 wherein said longitudinal groove and said straight groove have generally V-shaped configurations.

10. Drawing compass apparatus according to claim 1 wherein said circular member includes a scale section disposed along a part of the periphery thereof.

* * * * *